US006056367A

United States Patent [19]

Hsiao

[11] Patent Number: 6,056,367

[45] Date of Patent: May 2, 2000

[54] CHAIR STRUCTURE

[76] Inventor: Yun-Chien Hsiao, No. 9, Lane 307, Sec. 2, Hai-Tien Rd., Tainan, Taiwan

[21] Appl. No.: 09/299,815

[22] Filed: Apr. 26, 1999

[51] Int. Cl.[7] ..... A47C 7/02

[52] U.S. Cl. ..... 297/452.63; 297/463.2; 297/463.1

[58] Field of Search ..... 297/452.63, 463.1, 297/463.2, 452.56

[56] References Cited

U.S. PATENT DOCUMENTS

| | | | |
|---|---|---|---|
| 3,039,763 | 6/1962 | Staples et al. | 297/452.56 |
| 3,226,285 | 12/1965 | Iovenko | 297/452.63 |
| 3,565,487 | 2/1971 | Reiter | 297/452.63 |
| 3,667,532 | 6/1972 | Kurz | 297/452.63 |
| 3,695,706 | 10/1972 | Basher et al. | 297/452.56 |

*Primary Examiner*—Anthony D. Barfield
*Attorney, Agent, or Firm*—Kolisch Hartwell Dickinson McCormack & Heuser

[57] ABSTRACT

A chair includes a seat frame with four legs and a backrest frame. Each of the seat frame and the backrest frame has a plurality of connecting members connected to two sides thereof and a plurality of flexible strips connected between the connecting members. Four bags are respectively mounted to the two sides of the seat frame and the backrest frame and the bags enclose the connecting members on the seat frame and the backrest frame. Each of the bags has foam material filled therein so that the bags are soft.

9 Claims, 6 Drawing Sheets

CHAIR STRUCTURE

FIELD OF THE INVENTION

The present invention relates to chair with a plurality of flexible strips inter-connected between two sides of the seat and the backrest. Each flexible strip is connected between two connecting members which are fixedly connected to the seat and the backrest. The connecting members are enclosed by bags so as to provide a comfortable feature.

BACKGROUND OF THE INVENTION

A conventional leisure chair, as shown in FIG. 1, includes a seat (10), a backrest (13) and four legs (14) extending from the seat (10). Each of the seat (10) and the backrest (13)) has a frame with a plurality of flexible strips ( 11) connected between two sides thereof. A plurality of connecting members (12) are fixedly attached to the opposite sides of each of the seat frame and the backrest frame so that two flexible strips (11) are connected between two corresponding connecting members (12) on the opposite sides of the seat frame and the backrest frame. The connecting members (12) are riveted to the seat frame and the backrest frame, and they are stiff so that a person sitting in the chair may feel uncomfortable. Furthermore, a person sitting in the chair could tangle their hair in the connecting members (12).

The present invention intends to provide a chair wherein the connecting members are in bags in which foam material is retained.

SUMMARY OF THE INVENTION

In accordance with one aspect of the present invention, a chair is provided and comprises a seat frame with a supporting member and a backrest frame connected to the seat frame. Opposite sides of the seat frame and the backrest frame have a plurality of connecting members connected thereto and a plurality of flexible strips are connected between the connecting members.

Two bags are respectively mounted to the opposite sides of the seat frame and the backrest frame so that the connecting members together with the two opposite sides of the seat frame and the backrest frame are enclosed in the bags. Each bag has a plurality of apertures defined therethrough for the flexible strips to extend between the connecting members. An engaging means is connected to two longitudinal sides of each bag. Each bag has a tightening tab extending laterally from each end thereof so as to securely wrap around the seat frame and the backrest frame.

The object of the present invention is to provide a chair with flexible strips connected between the two sides of the seat frame and the backrest frame, the flexible strips connected between connecting members on the seat frame and the backrest frame and the two sides of the seat frame and the backrest frame together with the connecting members are enclosed by bags in which foam material is filled.

Further objects, advantages, and features of the present invention will become apparent from the following detailed description with appropriate reference to the accompanying drawings.

DETAILED DESCRIPTION OF THE PREFERRED EMBODIMENTS

Figure 1:
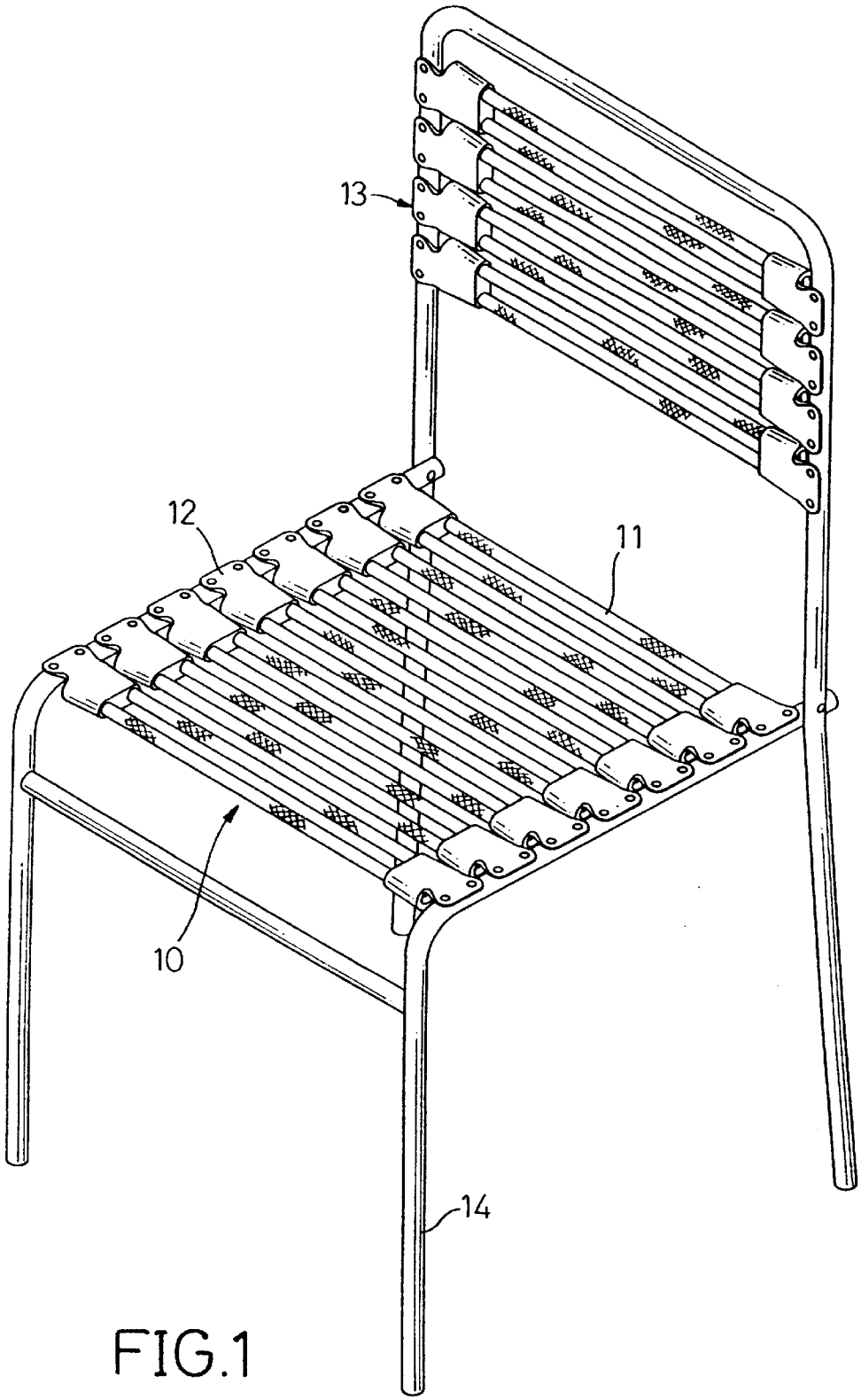
FIG.1 PRIOR ART
FIG. 1 is a perspective view of a conventional chair.
Figure 2:
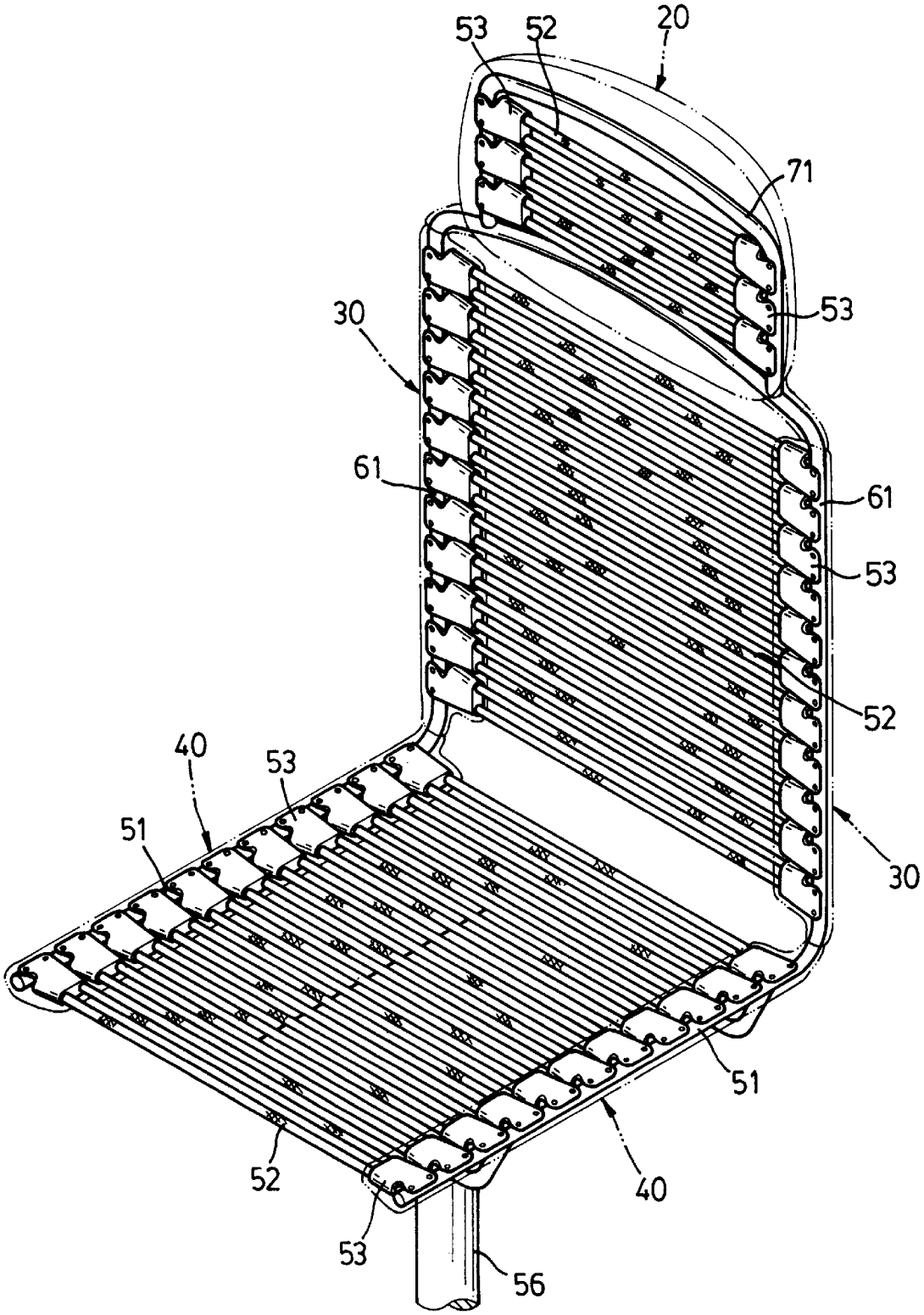
FIG. 2 is a perspective view of the chair in accordance with the present invention.
Figure 9:
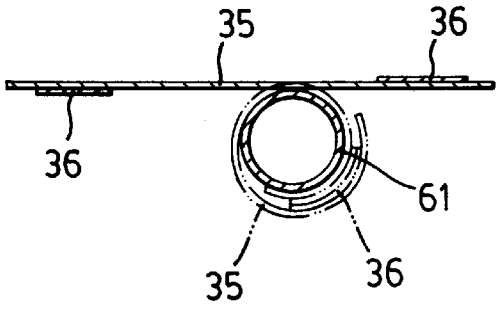
FIG. 9 is a cross-sectional view of one end of the bag enclosing one side of the backrest frame and the connecting member in accordance with the present invention.
Figure 3:
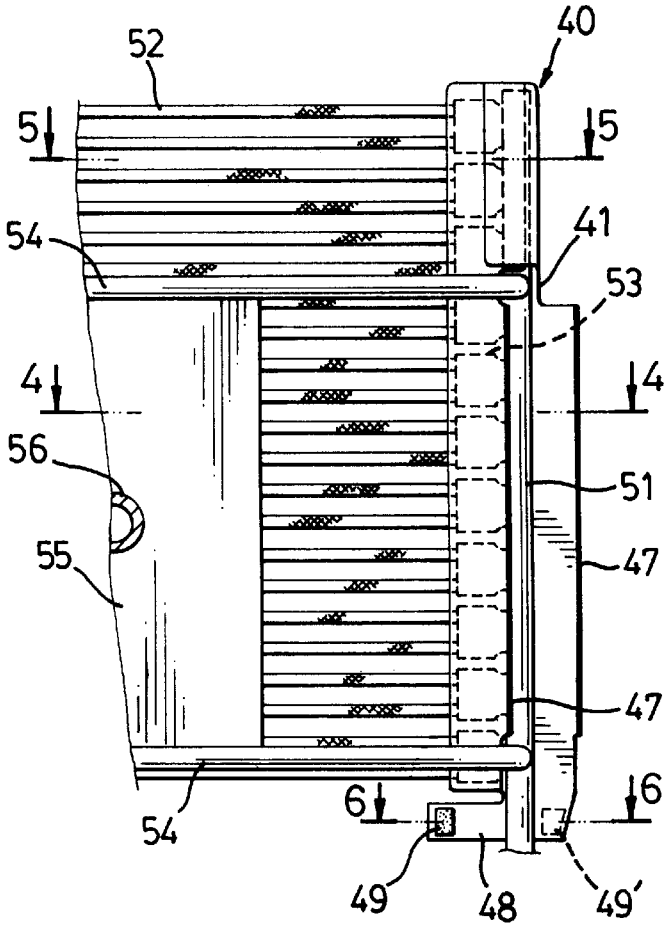
FIG. 3 is an bottom view to show the seat frame and the bag mounted to one side of the seat frame of the chair of the present invention.

Referring to FIGS. 2 to 6, the chair in accordance with the present invention comprises a seat frame (51), a backrest frame (61) connected to the seat frame (51) and a supporting member (56) connected to the bottom of the seat frame (51). The two sides of each of the seat frame (51) and the backrest frame (61) have a plurality of connecting members (53) connected thereto and a plurality of flexible strips (52) connected between the connecting members (53) on the two sides of the seat frame (51) and the backrest frame (61). Each connecting member (53) has a tongue (531) (FIGS. 4, 5) extending therefrom which is fixedly connected to the seat frame (51) and the backrest frame (61).

Figure 4:
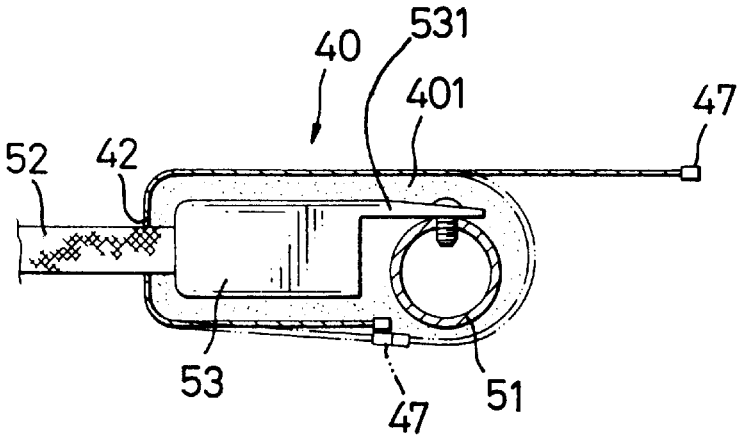
FIG. 4 is a cross-sectional view of the bag enclosing one side of the seat frame and the connecting member in accordance with the present invention.

Two first bags (40) are respectively mounted to the two sides of the seat frame (51) so as to enclose the connecting members (53) on the seat frame (51) and the two sides of the seat frame (51). Each first bag (40) has a plurality of apertures (42) (FIGS. 4, 5) defined therethrough for the flexible strips (52) to extend between the connecting members (53). The seat frame (51) has two bars (54) connected between the two sides thereof and a supporting board (55) is connected between the two bars (54) so that the supporting member (56) is connected to the supporting board (55). Each bag (40) has a notch (41) defined in the first longitudinal side thereof which is located on the outside of the seat frame (51) so that ends of the two bars (54) are respectively received in the two notches (41) of the two first bags (40). Referring to FIG. 4, an engaging means (47) is connected to the first and second longitudinal sides of each first bag (40) and located between the two bars (54) so that the two longitudinal sides of each first bag (40) between the two bars (54) can be connected by the engaging means (47) which can be a zipper or Velcro.

Figure 5:
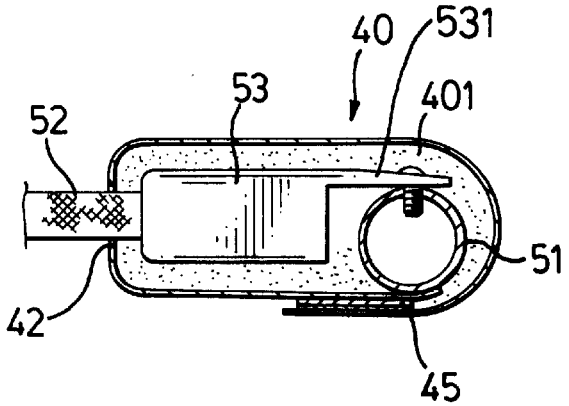
FIG. 5 is a cross-sectional view of one end of the bag enclosing one side of the seat frame and the connecting member in accordance with the present invention.

As shown in FIG. 5, the section of the first longitudinal side having no engaging means (47) thereon on the first end of each first bag (40) can be folded inwardly toward the second longitudinal side to receive the side of the seat frame (51). A Velcro fastener (45) is located between the two longitudinal sides of the section having no engaging means (47) thereon.

Figure 6:
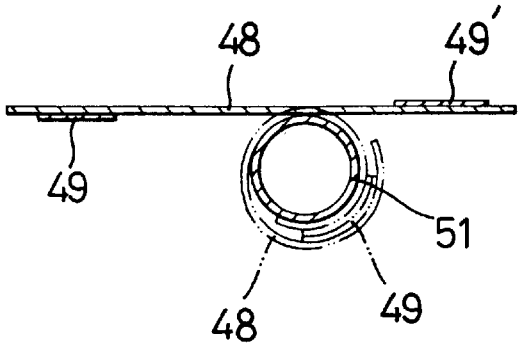
FIG. 6 is a cross-sectional view of the other end of the bag enclosing the side of the seat frame and the connecting member in accordance with the present invention.

As shown in FIG. 6, a tightening tab (48) extends laterally from the second longitudinal side of each first bag (40) so as to securely wrap around the seat frame (51) by two Velcro fasteners (49, 49') attached between the tab (48) and the second longitudinal side. In order to let the first bags (40) to be soft and comfortable, foam material (401) is filled in each of the first bags (40) so that a person sitting in the chair will not contact the solid connecting members (53) and the seat frame (51).

Figure 7:
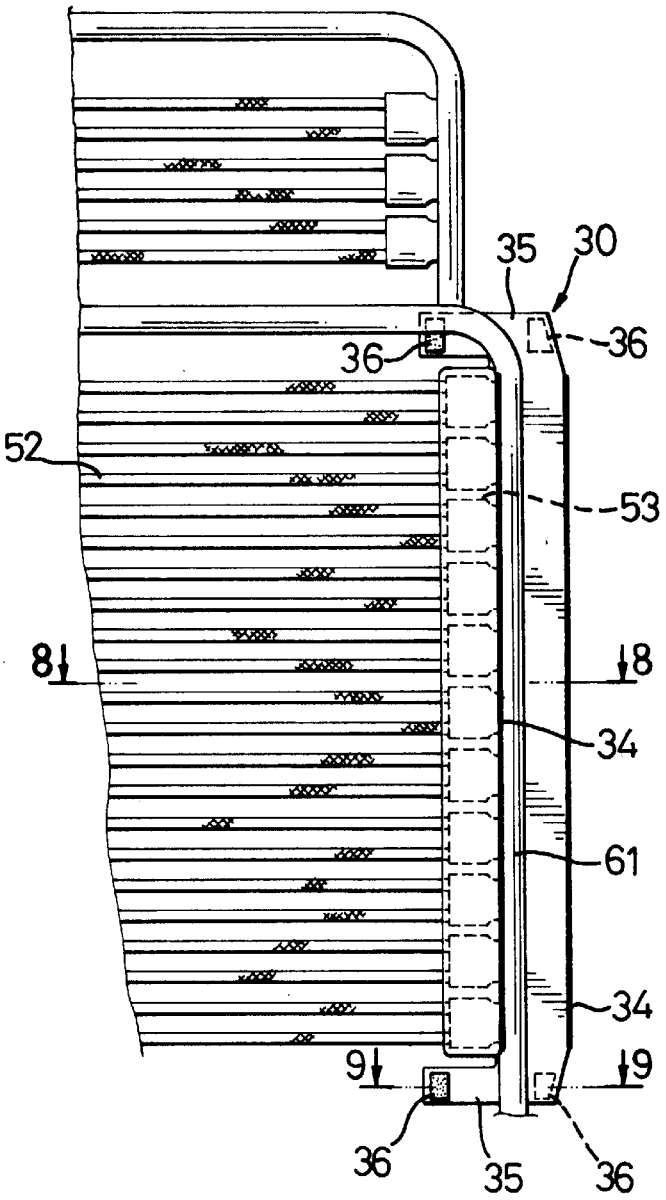
FIG. 7 is an view to illustrate a bag mounted to one side of the backrest frame of the chair of the present invention.
Figure 8:
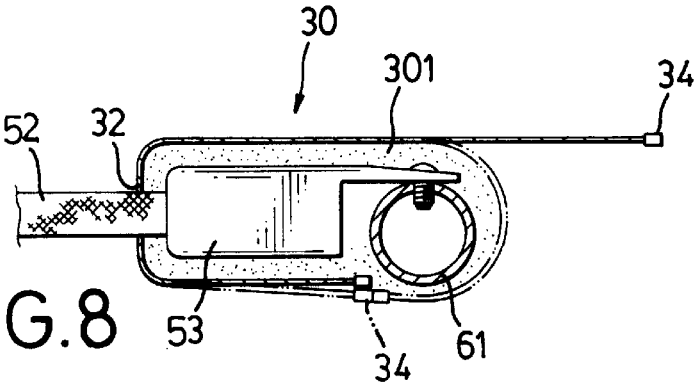
FIG. 8 is a cross-sectional view of one end of the bag enclosing one side of the backrest frame and the connecting member in accordance with the present invention.

FIGS. 7 and 8 show two second bags (30) attached to the two sides of the backrest frame (61) to enclose the two sides of the backrest frame (61) and the connecting members (53) on the backrest frame (61). Each second bag (30) has an engaging means (34) on the two longitudinal sides thereof so that the two longitudinal sides of each second bag (30) are connected with each other. A plurality of apertures (32) are defined through each second bag (30) so as to let the flexible strips (52) extend therethrough. Two tabs (35) respectively extend from the inside of the ends of each second bag (30) so as to be folded toward and securely attached to the outer side of the second bag (30) by a Velcro member (36) to enclose the backrest frame (61) in the two ends of the second bag (30). Foam material (301) is filled in each second first bag (30) so that a person sitting in the chair will not contact the solid connecting members (53) and the seat frame (51).

Figure 10:
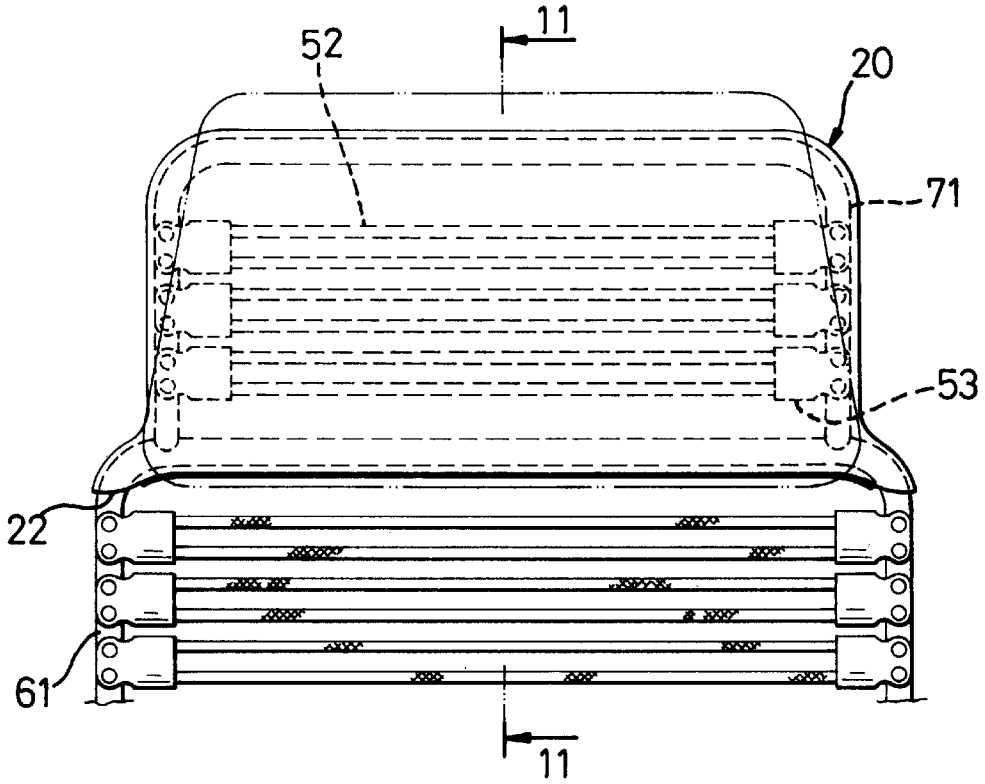
FIG. 10 is an view to show a cover mounted on the headrest of the chair of the present invention.
Figure 11:
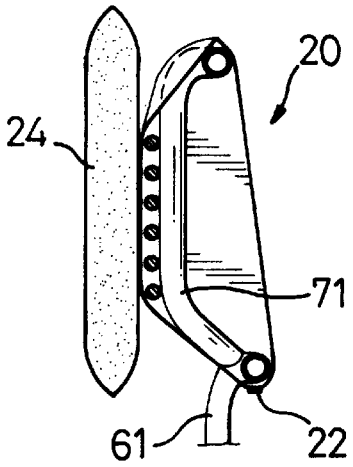
FIG. 11 is a cross-sectional view to show the headrest covered by the cover and a sponge member connected to the headrest frame.

Referring to FIGS. 10 and 11, a headrest frame (71) is connected to the top of the backrest (61) and a plurality of connecting members (53) are connected to two sides of the headrest frame (71) and a plurality of flexible strips (52) are connected between the connecting members (53) on the two sides of the headrest frame (71). A cover (20) is mounted to the headrest frame (71) and a sponge pad (24) is connected to the headrest frame (71). The cover (20) has an open bottom and a Velcro member (22) is connected to the periphery defining the open bottom of the cover (20) so as to secure the cover (20) to the head rest frame (71).

Although the invention has been explained in relation to its preferred embodiment, it is to be understood that many other possible modifications and variations can be made without departing from the spirit and scope of the invention as hereinafter claimed.

What is claimed is:

1. A chair comprising:

a seat frame, a backrest frame connected to said seat and a supporting member connected to the bottom of said seat frame, two sides of said seat frame and said backrest frame having a plurality of connecting members connected thereto and a plurality of flexible strips connected between said connecting members on said two sides of said at least one of said seat frame and said backrest frame, and two bags respectively mounted to each of the two sides of said seat frame and said backrest frame, said connecting members on said seat frame and said backrest frame enclosed in said bags, each bag having a plurality of apertures defined therethrough for said flexible strips to extend between said connecting members, an engaging means connected to two longitudinal sides of each bag, each bag having a tightening tab extending laterally from each end thereof so as to securely wrap around said seat frame and said backrest frame.

2. The chair as claimed in claim 1, wherein each said tightening tab has a first adhesive member attached thereon, and each end of said seat frame and said backrest frame has a second adhesive member attached thereon.

3. The chair as claimed in claim 1 further comprising foam material filled in each of said bags.

4. The chair as claimed in claim 1 further comprising a headrest frame connected to said backrest and a plurality of connecting members connected to two sides of said headrest frame, a plurality of flexible strips connected between said connecting members on said sides of said headrest frame.

5. The chair as claimed in claim 4 further comprising a cover mounted to said headrest frame.

6. The chair as claimed in claim 1 further comprising two bars connected between the two sides of said seat frame and a supporting board connected between said two bars, said supporting member connected to said supporting board.

7. The chair as claimed in claim 6, wherein each bag on said seat frame has a notch defined in one of two longitudinal sides thereof so that one of said two bars is received in said notch.

8. The chair as claimed in claim 7, wherein said engaging means on said two longitudinal sides of each bag on said each frame is located between said two bars.

9. The chair as claimed in claim 1, wherein each connecting member has a tongue extending therefrom which is fixedly connected to one of said seat frame and said backrest frame.

* * * * *